US008342429B2

(12) United States Patent
Grether

(10) Patent No.: US 8,342,429 B2
(45) Date of Patent: Jan. 1, 2013

(54) SANITARY OUTLET FITTING

(75) Inventor: Hermann Grether, Muellheim (DE)

(73) Assignee: Neoperl GmbH, Muellheim (DE)

( * ) Notice: Subject to any disclaimer, the term of this patent is extended or adjusted under 35 U.S.C. 154(b) by 142 days.

(21) Appl. No.: 12/739,110

(22) PCT Filed: Oct. 11, 2008

(86) PCT No.: PCT/EP2008/008613

§ 371 (c)(1),
(2), (4) Date: Sep. 15, 2010

(87) PCT Pub. No.: WO2009/052961

PCT Pub. Date: Apr. 30, 2009

(65) Prior Publication Data

US 2011/0006132 A1 Jan. 13, 2011

(30) Foreign Application Priority Data

Oct. 22, 2007 (DE) ..... 10 2007 050 737

(51) Int. Cl.
*E03C 1/086* (2006.01)
*E03C 1/08* (2006.01)
*E03C 1/084* (2006.01)

(52) U.S. Cl. ..... 239/428.5; 239/600

(58) Field of Classification Search ..... 239/428.5, 239/589, 600; 138/37
See application file for complete search history.

(56) References Cited

U.S. PATENT DOCUMENTS 2,989,249 A * 6/1961 Richter ..... 239/427
3,138,332 A 6/1964 Hinderer
4,365,755 A * 12/1982 Aghnides ..... 239/428.5
2006/0163386 A1 7/2006 Weis et al.
2008/0149743 A1 6/2008 Weis et al.

FOREIGN PATENT DOCUMENTS

| | | |
|---|---|---|
| CH | 380042 | 7/1964 |
| DE | 93 17 654.6 U1 | 3/1994 |
| DE | 198 05 691 A1 | 8/1999 |
| DE | 102 49 340 A1 | 5/2004 |
| GB | 1 282 957 | 7/1972 |
| WO | WO 2004/037113 A1 | 5/2004 |
| WO | WO 2004/038112 A1 | 5/2004 |

OTHER PUBLICATIONS

PCT/IPEA/409 (seven (7) pages).
Form PCT/ISA/237 with partial English translation (Eight (8) pages).
Form PCT/IPEA/428 with partial English translation (Eight (8) pages).
Form PCT/IPEA/409 with English translation (Nine (9) pages).
International Search Report (Form PCT/ISA/210) dated Feb. 2, 2009 with partial English translation (Seven (7) pages).

* cited by examiner

*Primary Examiner* — Darren W Gorman
(74) *Attorney, Agent, or Firm* — Crowell & Moring LLP

(57) ABSTRACT

A sanitary outlet fitting with a liquid guide which opens into an outlet fitting, in the region of which an insertable cartridge is provided. The liquid guide is matched in at least the mouth region of the outlet fitting to the insertable cartridge. The insertable cartridge is held in the outlet fitting by a sleeve-shaped intermediate holder, which is held in the outlet fitting in a radially sealed manner. A peripheral edge region on the admission side of the insertable cartridge is held in an axially sealed manner in the outlet fitting. The insertable cartridge is inserted with the aid of the intermediate holder supporting it into the outlet fitting to a depth such that the insertable cartridge is held securely. Accordingly, the insertable cartridge is scaled axially in its peripheral region on the admission side. The intermediate holder can also be held in a radially sealed manner in the outlet fitting to prevent undesired creepage.

12 Claims, 3 Drawing Sheets

SANITARY OUTLET FITTING

CROSS REFERENCE TO RELATED APPLICATIONS

This application is a U.S. National Phase of PCT International Application No. PCT/EP2008/008613, filed Oct. 11, 2008, which claims priority under 35 U.S.C. §119 to German Patent Application No. 10 2007 050 737.4, filed Oct. 22, 2007, the entire disclosures of which are herein expressly incorporated by reference.

BACKGROUND AND SUMMARY OF THE INVENTION

The invention relates to a sanitary outlet fitting having a liquid guide that opens in a fitting outlet, in the area of which a sanitary functional unit is provided that is embodied as an insertable cartridge. The liquid guide is adapted in the open cross-section, at least in the mouth area of the fitting outlet, to the insertable cartridge. The insertable cartridge can be inserted into the fitting outlet from the mouth side using a sleeve-shaped intermediate holder and is held releasably therein. The intermediate holder itself is releasably held in the fitting outlet using a screw or bayonet connection and the insertable cartridge is axially sealed on its supply-side circumferential edge area, with respect to the fitting outlet, using an annular seal.

In outlet fittings, a flow regulator, generally embodied as an insertable cartridge, is typically provided in the area of the fitting outlet. The flow regulator is intended to form a homogenous, non-spraying and, sometimes, sparkling-soft flow of water. This flow regulator can be inserted into a sleeve-shaped outlet mouthpiece that is releasably attached to the fitting outlet using a screw connection. This screw connection necessarily has a round outer cross-section for the outlet fitting in the area of its fitting outlet, which sharply limits the opportunities for esthetically configuring such outlet fittings. Moreover, an unattractive circumferential annular gap remains between the outlet mouthpiece and the adjacent region of the outlet fitting, which can also have a significant negative effect on the esthetic appearance of such outlet fittings. In addition, producing such outlet fittings is associated with significant complexity if the outer surfaces of the outlet mouthpiece and the outlet fitting are to be matched to one another.

DE 102 49 340 A1, discloses a sanitary outlet fitting whose liquid guide opens in a fitting outlet in the area of which a sanitary functional unit is provided that is embodied as an insertable cartridge. The liquid guide is adapted in its open cross-section, at least in the mouth area of the fitting outlet, to the insertable cartridge such that the latter can be inserted into the fitting outlet from the mouth side and is releasably held therein. The outlet fitting renders the outlet mouthpiece, which is otherwise customary, unnecessary. DE 102 49 340 A1 also discloses an embodiment in which the insertable cartridge is held in the fitting outlet using a sleeve-shaped intermediate holder. This intermediate holder is releasably held in the fitting outlet using a screw connection. In order to prevent creeping flows past the insertable cartridge between the inner circumference of the fitting outlet and the intermediate holder, a sealing ring is provided that effects radial sealing. Relatively tight production standards must be maintained in order to attain this radial sealing effect, however, and these production tolerances cannot be attained without relatively high production complexity. Moreover, there is the risk that the insertable cartridge and the intermediate holder carrying it will be screwed too deep and/or too tight beyond the normal measure into the fitting outlet due to the lack of an axial stop so that subsequent removal is difficult or these components are damaged by overloading during installation. Moreover, drops that collect on the cartridge housing can overflow onto the outlet fitting when an insertable cartridge has been screwed too deeply into the fitting outlet and can then move downward on the outer circumference of the outlet fitting, leaving unattractive drip marks.

DE 198 05 691 A discloses a sanitary outlet fitting having a liquid guide that opens into a fitting outlet. The fitting outlet, in whose area a flow regulator embodied as an insertable cartridge is provided, has in its mouth area an open cross-section that is adapted to the insertable cartridge. The flow regulator embodied as an insertable cartridge can be inserted into the fitting outlet from the mouth side and can be releasably held therein using an intermediate holder that is embodied as a threaded sleeve and that can be screwed into a female thread in the fitting outlet by means of a male thread provided on the sleeve circumference. A sealing ring is placed on the flow regulator, and it axially seals the insertable cartridge in its supply-side circumferential edge area in the fitting outlet. When pre-installed or uninstalled, the individual parts for the outlet fitting, including flow regulator 3, intermediate holder 4, and sealing ring 2, are at best only loose next to one another so that individual parts can easily be lost during storage or transport and ultimately are not available when needed.

CH 380 042 A and GB 1 282 957 A disclose aerated flow regulators that have a flow regulator housing, embodied as an air suction cylinder, that accommodates various water-guiding parts in its housing interior. The flow regulator housing can be used immediately, without an intermediate holder, in the fitting outlet of a sanitary outlet fitting. On its outer housing circumference, the flow regulator housing also has a male thread that can be screwed into a female thread on the inner circumference of the fitting outlet. Since the flow regulators are held immediately in the fitting outlet of a sanitary outlet fitting, without an intermediate holder, these flow regulators and the associated outlet fittings must be adapted to one another, with the corresponding complexity in design and production.

An object of the present invention is to create an outlet fitting of the aforesaid type that can be produced with relatively low complexity and in which the risk of improper installation is significantly reduced.

This object is inventively attained with an outlet fitting of the aforesaid type in which securing and/or supporting on the intermediate holder occurs in the pre-installed and/or uninstalled position using the annular seal. Additionally, the annular seal has a cap shape, and in that the inner circumferential edge area of the annular seal is embodied as an annular sealing area and the outer circumferential edge area of the annular seal projects over the annular sealing area in a tube-like manner and is releasably held on the intermediate holder.

The inventive outlet fitting has an insertable cartridge that can be mounted in the fitting outlet using a sleeve-shaped intermediate holder such that the insertable cartridge is held in the fitting outlet. In order to prevent creeping flows in the area between the insertable cartridge and its intermediate holder and the inner circumference of the fitting housing, the insertable cartridge is held axially sealed in the fitting outlet. The insertable cartridge, using the intermediate holder that is supporting it, is inserted into the fitting outlet until the insertable cartridge is held, preferably in its supply side circumferential edge area, axially sealed in the fitting outlet. The axial seal prevents the insertable cartridge and its intermediate holder from being screwed in too much, so that improper installation is practically impossible in this regard. Because of the axial seal, the production tolerances can also be significantly more generous, which further simplifies the production and handling of the insertable cartridge provided for the inventive outlet fitting. In addition, however, the intermediate holder can also be held radially sealed in the fitting outlet. If the inventive outlet fitting has an axial seal on its insertable cartridge and additionally an axial seal on the associated intermediate holder, a sanitary fittings manufacturer has the option of deciding whether an axial seal, a radial seal, or the combination of one radial and one axial seal should be used in its sanitary fitting.

An axial seal also acts against undesired creeping flows in the area between the insertable cartridge and the intermediate holder.

In accordance with the invention, the insertable cartridge is secured and/or held on the intermediate holder in the pre-installed and/or uninstalled position using the annular seal. The annular seal has a cap shape in order to fix the insertable cartridge on the intermediate holder and also to be able to hold the functional unit formed by the insertable cartridge and intermediate holder in the pre-installed and/or uninstalled position. The inner circumferential edge area of the annular seal is configured as an annular sealing area, while the outer circumferential edge area of the annular seal projects over the annular sealing area in a tube-like manner and is releasably held on the intermediate holder.

One exemplary embodiment in accordance with the invention provides that the liquid guide has an annular shoulder in the area of the fitting outlet and that the annular seal is clamped between the insertable cartridge and the annular shoulder for axially sealing the insertable cartridge. This annular shoulder also acts as an insertion stop that limits the maximum depth the insertable cartridge can be inserted into the fitting outlet.

The annular shoulder can be formed by a change in the cross-section of the liquid guide or by an annular flange in the liquid guide. One embodiment in particular can be produced with relatively low complexity. In it, the annular shoulder is formed by a change in cross-section and especially by a jump in the diameter of the open flow cross-section in the insertion direction.

In order to effectively counteract unintended release of the annular seal from the intermediate holder, it is advantageous for the annular seal to be held on the intermediate holder in a friction and/or positive fit.

In order to ensure that the insertable cartridge is also properly positioned with respect to the intermediate holder, it is advantageous when the insertable cartridge can be inserted up to a stop in the intermediate holder.

In addition, a stop can be provided on the inner circumference of the intermediate holder. However, in one exemplary embodiment the stop is provided on the outer circumference of the insertable cartridge and acts on the supply-side face edge of the intermediate holder. The stop provided on the insertable cartridge or on the intermediate holder can be embodied as an annular shoulder or annular flange.

One aspect of the invention relates to a sanitary outlet fitting having a liquid guide that opens in a fitting outlet, in the area of which a sanitary functional unit embodied as an insertable cartridge is provided, the liquid guide being adapted in the open cross section, at least in the mouth area of the fitting outlet, to the insertable cartridge, which insertable cartridge can be inserted from the mouth side into the fitting outlet by means of a sleeve-shaped intermediate holder and is releasably held therein, and which intermediate holder for its part is releasably held in the fitting outlet by means of a screw or bayonet connection. In order to fix the insertable cartridge in the fitting outlet, using such an intermediate holder, and to be able to install the intermediate holder using a plug-in and/or rotational movement using a bayonet or screw connection in the fitting outlet, in accordance with this aspect the outflow-side face edge area for the intermediate holder has a profile embodied as a tool gripping surface such that in addition the intermediate holder and the rotation tool are provided and such that the profile of the intermediate holder can be releasably coupled to the profile of another, preferably identically structured, intermediate holder.

The inventive outlet fitting can especially make best use of its advantages when the insertable cartridge is embodied as a flow regulator or has a flow regulator.

Another embodiment in accordance with the invention provides that at least one annular seal is provided that seals radially in the annular space between the intermediate holder and the inner circumference of the fitting.

It is particularly advantageous when the annular seal is embodied as an elastic sealing ring. Such a sealing ring can also be removed when needed if, for instance, only the axial seal is to be used on the insertable cartridge. In order not to unintentionally lose the annular seal provided on the intermediate holder, it is useful when at least one annular seal is held on the intermediate holder in a groove on the outer circumference side.

Additional features of the invention result from the following description of inventive exemplary embodiments in conjunction with the claims and the drawings. The individual features can each be realized individually or a plurality can be realized in an embodiment in accordance with the invention.

BRIEF DESCRIPTION OF THE DRAWINGS

The following are shown.

DETAILED DESCRIPTION OF THE DRAWINGS

Figure 1:
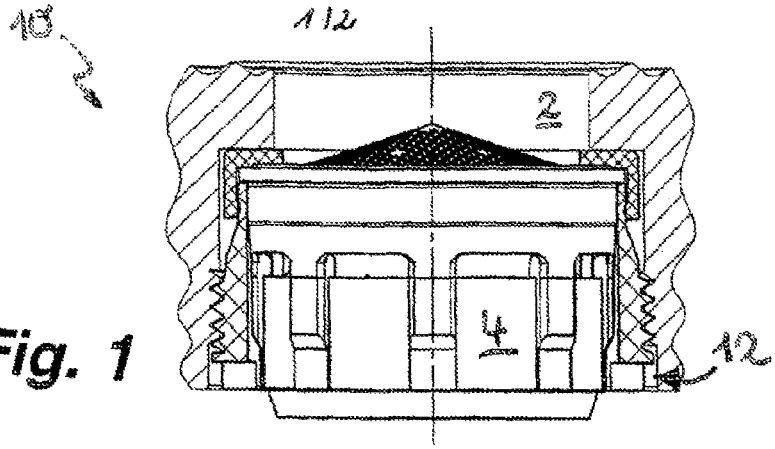
FIG. 1 is a partial longitudinal cross-section of a sanitary outlet fitting in the area of its fitting outlet, an insertable cartridge being inserted into the fitting outlet from the mouth side, the insertable cartridge being held in the fitting outlet using a sleeve-shaped intermediate holder, the insertable cartridge being sealed in the fitting outlet using an axial annular seal, and the annular seal here having a cap shape and being held on the intermediate holder in a friction fit and positive fit using its tube-like projecting outer circumferential edge area.

FIGS. 1 through 5 depict different embodiments 10, 100 of a sanitary outlet fitting. The outlet fitting 10, 100 has liquid guide 2 that opens in a fitting outlet 3. Provided in the area of the fitting outlet 3 is a sanitary functional unit, embodied as an insertable cartridge 4, that here is embodied as an aerated flow regulator that is intended to produce a homogenous, non-spraying, and sparkling-soft flow of water. However, it is also possible for the flow regulator to be embodied as a non-aerated flow regulator.

Figure 5:
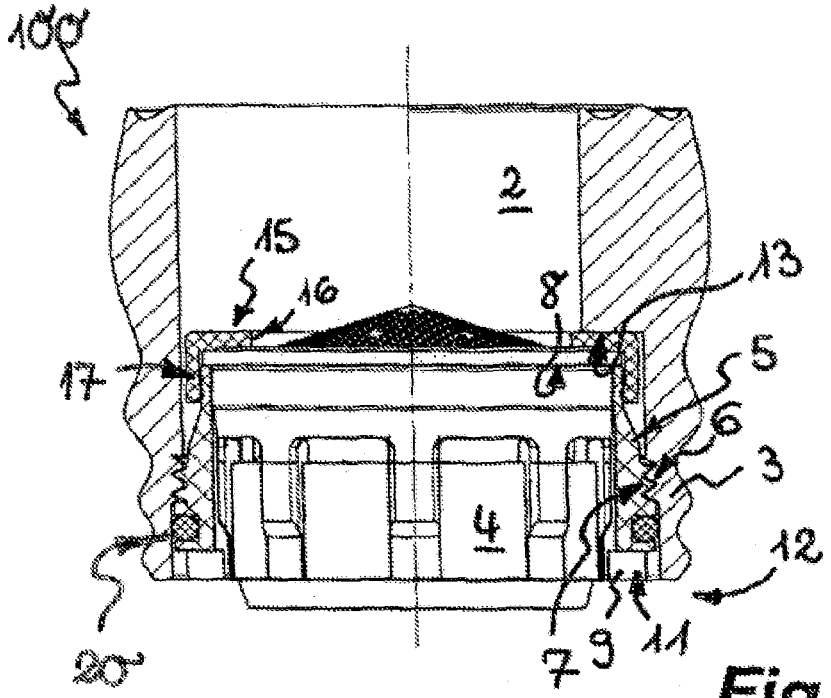
FIG. 5 depicts an insertable cartridge that is installed in the area of the fitting outlet and that is secured in the fitting outlet using a sleeve-shaped intermediate holder, the installation depicted on the left side of the drawing being in a pipe outlet in which only the radial seal of the insertable cartridge or its intermediate holder is used, while in the installation depicted on the right side of the drawing a radial seal is provided on the intermediate holder in addition to the axial seal for the insertable cartridge.
Figure 6A:
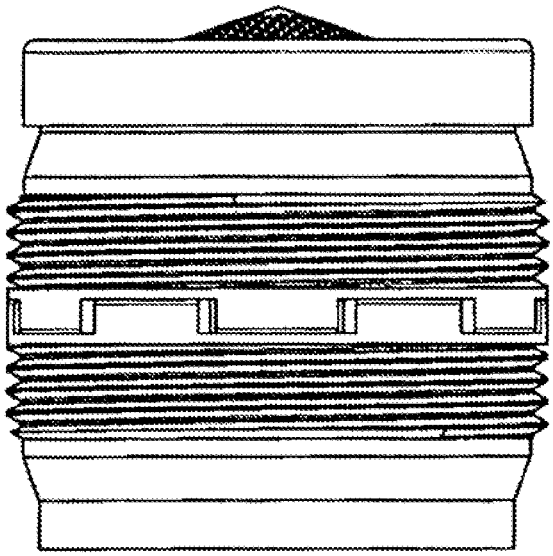
FIGS. 6A and 6B depict the crenellated profile of two intermediate holders coupled to each other.
Figure 6B:
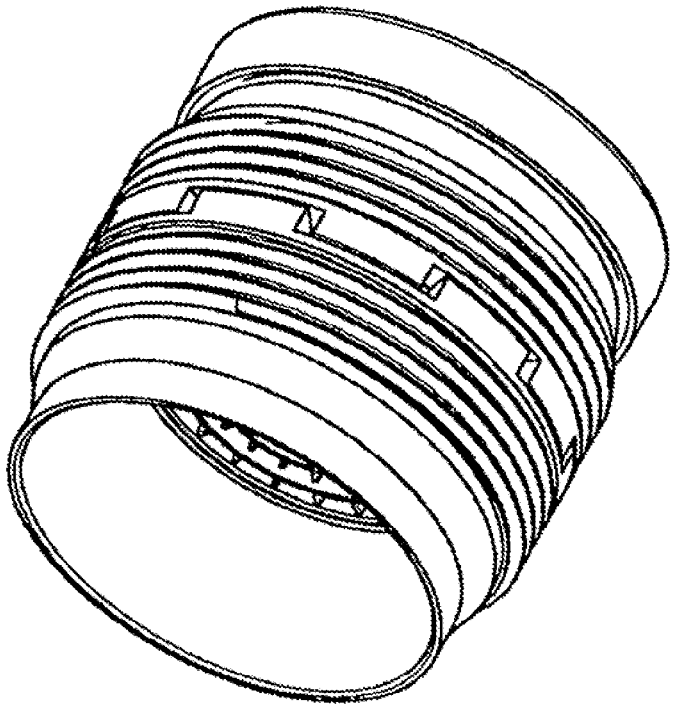

It is clear from FIGS. 1 and 5 that the liquid guide 2 is adapted in the open cross-section, at least in the mouth area of the fitting outlet 3, to the insertable cartridge 4 such that the insertable cartridge 4 can be inserted into the fitting outlet 3 from the mouth side and is releasably held there. Associated with the insertable cartridge 4 is a sleeve-shaped intermediate holder 5, the outer sleeve circumference of which has a male thread 6 and thus can be screwed into a female thread 7 in the fitting outlet 3.

As can be seen from FIGS. 1 and 5, the insertable cartridge 4 can be inserted into the intermediate holder 5 up to a stop. Here this stop is provided on the outer circumference of the insertable cartridge 4 and embodied as an annular flange 8 arranged on the supply face side that acts on the supply-side face edge of the intermediate holder 5.

It is clear from FIGS. 1, 3, 4, 5, 6A and 6B that the outflow-side face edge area of the intermediate holder 5 has a crenellated profile 12 that is formed by alternating depressions and projections 9, 11 that act as a tool gripping surface. This profile 12 can be releasably coupled to the profile 12 of an identically structured other intermediate holder 5 that can thus be used as a rotating tool.

Figure 2:
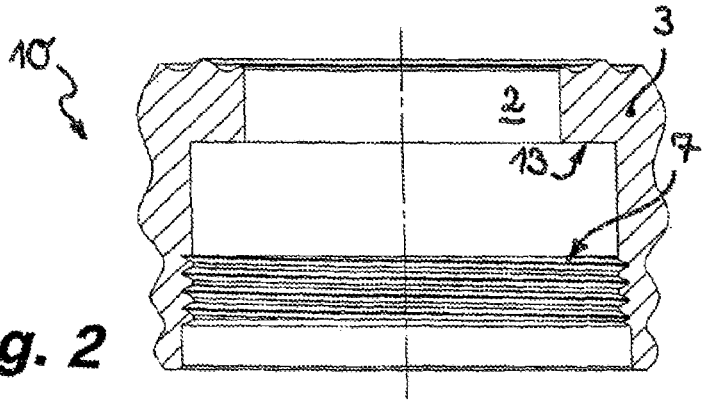
FIG. 2 is a longitudinal section of the outlet fitting from FIG. 1, it being possible to shape the cavity intended for receiving the insertable cartridge in accordance with FIG. 1 much more simply.
Figure 4:
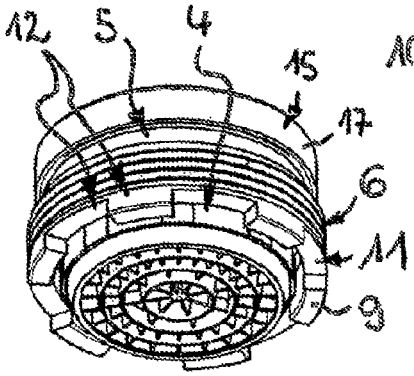
FIG. 4 provides a perspective top view of the insertable cartridge and the intermediate holder from FIGS. 1 through 3, looking onto the outlet face sides.

It can be seen from FIGS. 1, 2 and the right side of FIG. 5 that the liquid guide 2 of the outlet fitting 10, 100 has, in the area of the fitting outlet 3, an annular shoulder 13, and held by the intermediate holder is an annular seal 15 for axial sealing clamped between it and the insertable cartridge 4.

Each of the outlet fittings 10, 100 depicted has an insertable cartridge 4 that can be installed in the fitting outlet 3 using the sleeve-shaped intermediate holder 5 such that the insertable cartridge 4 is held, axially sealed, in its supply-side circumferential edge area in the fitting outlet 3. The insertable cartridge is inserted into the fitting outlet 3 using the intermediate holder 5 supporting it until the insertable cartridge 4 is held, axially sealed, in its supply-side circumferential edge area in the fitting outlet 3. The insertable cartridge 4 and its intermediate holder 5 are prevented from penetrating too far by the axial seal and the annular shoulder 13, so the risk of improper installation is practically not possible in this regard. Because of the axial seal, the production tolerances can also be significantly more generous, which further simplifies the production and handling of the insertable cartridge 4 provided for the inventive outlet fittings 10 depicted here. In the embodiment 10, 100 depicted in FIGS. 1 through 4 and FIG. 5, the annular seal 15 has a cap shape. The annular seal 15 has an inner circumferential edge area 16 embodied as an annular sealing area and an outer circumferential edge area 17 that projects over the annular sealing area in a tube-like manner and is releasably held on the intermediate holder 5.

Figure 3:
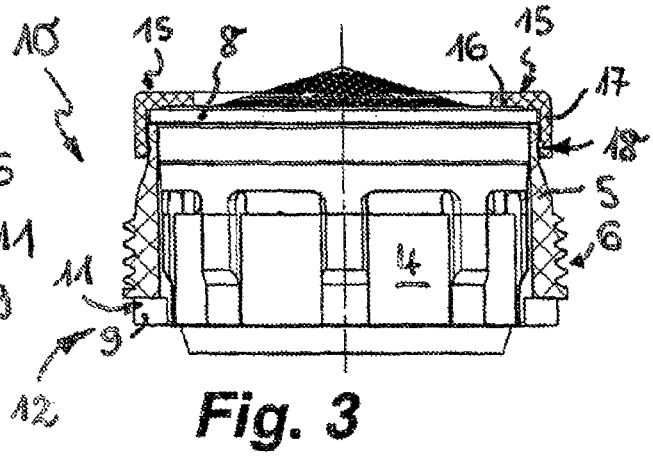
FIG. 3 depicts the unit in FIG. 1, formed from insertable cartridge and intermediate holder, which unit is held together, even in the pre-installed or uninstalled position, using the cap-shaped annular seal.

In order to effectively prevent unintended release of the annular seal 15 from the intermediate holder 5, the annular seal 15 is held on the intermediate holder 5 in a friction fit. In addition or instead, a catch projection 18 can also be provided on the annular seal 15 or on the intermediate holder 5 that engages in a catch groove provided on another component 5, 15. In FIGS. 1, 3, and 5, the catch projection 18 is provided on the circumferential edge area 17 of the annular seal 15 and engages in a catch groove on the outer circumference of the intermediate holder 5. Such a positive fit connection is not, however, absolutely necessary to be able to securely fix the annular seal 15 on the intermediate holder 5. On the contrary, it may be sufficient for the annular seal 15 just to be positioned against the outer circumference of the intermediate holder 5 in a friction fit.

The annular seal 15 ensures that the intermediate holder 5, insertable cartridge 4, and annular seal 15 are always installed in the correct position. Moreover, the cap-shaped annular seal 15 also secures the combination comprising intermediate holder 5, insertable cartridge 4, and annular seal 15 in the pre-installed and/or uninstalled position.

While the left side of FIG. 5 depicts an installation such as occurs, for instance, in a fitting outlet in which only one radial seal is desired on the intermediate holder, as frequently occurs for thin-walled outlet pipes, the right side of FIG. 5 depicts a situation like that which can be provided for cast fittings or thick-walled outlet pipes. It is clear from the right side of FIG. 5 that the insertable cartridge can have an axial seal and that moreover it is also possible to have a radial seal on the intermediate holder 5. The axial seal of the insertable cartridge 4 can also be used for an axial screw-in stop because it is difficult for many users not to tighten a flow regulator too tight in the fitting housing. In contrast, a radial seal does not have to be tightened securely, but rather the annular seal 20 only has to be pressed radially, which as a rule is accomplished when the threads of the outlet fitting and intermediate holder 5 engage in one another. The embodiment depicted in FIG. 5 has the advantage that the component formed from intermediate holder 5, insertable cartridge 4, and annular seal 15 can be used universally, especially when the consumer does not know whether his flow regulator is axially or radially sealed. In such a case, the component comprising intermediate holder 5, insertable cartridge 4, and annular seal 15 would always fit. Moreover, depending on the installation and production conditions, a sanitary fitting manufacturer has the opportunity to decide whether it wants an axial seal for the insertable cartridge 4, a radial seal for the intermediate holder 5, or the combination of these two seals.

Using an axial seal also counteracts undesired creeping flows in the area between the insertable cartridge 4 and the intermediate holder 5. In FIG. 5 it is clear that the annular seal 20 intended for radial sealing is provided in the annular space between the intermediate holder 5 and the fitting inner circumference. This annular seal 20 is embodied as an elastic sealing ring here. The annular seal 20 is held in a groove that is on the outer circumference side on the intermediate holder 5 in the flow direction beneath the male thread 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sanitary outlet fitting comprising:

a liquid guide that opens in a fitting outlet;

a sanitary functional unit that is an insertable cartridge arranged in the fitting outlet, wherein an open cross-section of an interior portion of the liquid guide has a shape substantially conforming, at least in a mouth area of the fitting outlet, to an exterior shape of the insertable cartridge;

a sleeve-shaped intermediate holder positioned in the fitting outlet, configured to releasably hold the insertable cartridge, and including a screw connection that engages with a corresponding connection on a radial interior of the fitting outlet; and a cap shaped annular seal configured on the insertable cartridge so that the cap shaped annular seal axially seals a supply-side circumferential edge area of the insertable cartridge, wherein the cap shaped annular seal holds the insertable cartridge on the intermediate holder in a pre-installed or uninstalled position, wherein an inner circumferential edge area of the annular seal is embodied as an annular sealing area and an outer circumferential edge area of the annular seal projects over the annular sealing area in a tube-like manner and is releasably held on the intermediate holder, and wherein the annular seal is arranged on an upper outer portion of the insertable cartridge that faces the radial interior of the fitting outlet and an upper outer portion of the intermediate holder that faces the radial interior of the fitting outlet, and the annular seal forms a radial seal at least in an area between the upper outer portion of the insertable cartridge and the upper outer portion of the intermediate holder.

2. The outlet fitting in accordance with claim 1, wherein the liquid guide has an annular shoulder in the area of the fitting outlet, and the annular seal is clamped between the insertable cartridge and the annular shoulder in order to axially seal the insertable cartridge.

3. The outlet fitting in accordance with claim 2, wherein the annular shoulder is formed by a change in the cross-section of the liquid guide or by an annular flange in the liquid guide.

4. The outlet fitting in accordance with claim 1 wherein the annular seal is held on the intermediate holder in a friction fit or positive fit.

5. The outlet fitting in accordance with claim 4, wherein the insertable cartridge is insertable up to a stop in the intermediate holder.

6. The outlet fitting in accordance with claim 5, wherein the stop is provided on the outer circumference of the insertable cartridge and acts on a supply-side face edge of the intermediate holder.

7. The outlet fitting in accordance with claim 5, wherein the stop is an annular shoulder or annular flange.

8. The outlet fitting in accordance with claim 1, wherein an outflow-side face edge area for the intermediate holder has a profile embodied as a tool gripping surface, the intermediate holder is a rotation tool, and the profile of the intermediate holder is releasably coupled to the profile of another, identically structured intermediate holder.

9. The outlet fitting in accordance with claim 8 wherein the insertable cartridge is a flow regulator or has a flow regulator.

10. The outlet fitting in accordance with claim 8, further comprising:

a second annular seal configured to radially seal in an annular space between the intermediate holder and an inner circumference of the fitting.

11. The outlet fitting in accordance with claim 10, wherein the second annular seal is an elastic sealing ring.

12. The outlet fitting in accordance with claim 10, wherein the second annular seal is held on the intermediate holder in a groove on an outer circumference side.

* * * * *